United States Patent [19]

Fefferman

[11] 4,217,669

[45] Aug. 19, 1980

[54] CONVERTIBLE SEAT

[75] Inventor: Frank J. Fefferman, Thousand Oaks, Calif.

[73] Assignee: Stylar Industries, Inc., Burbank, Calif.

[21] Appl. No.: 890,320

[22] Filed: Mar. 27, 1978

[51] Int. Cl.[2] ..... A47C 17/10

[52] U.S. Cl. ..... 5/47; 5/18 R; 297/65

[58] Field of Search ..... 5/18, 37 R, 44–48, 5/66; 297/65, 317, 318, 322, 383

[56] References Cited

U.S. PATENT DOCUMENTS

| | | | |
|---|---|---|---|
| 2,297,526 | 9/1942 | Bayer et al. | 5/47 |
| 3,132,897 | 5/1964 | Linden | 5/66 |
| 3,171,684 | 3/1965 | Carte | 5/48 |
| 3,252,734 | 5/1966 | Behlin | 297/322 |
| 3,806,192 | 4/1974 | Ohliogge | 297/318 |
| 4,048,680 | 9/1977 | Rogers, Jr. | 5/47 |

*Primary Examiner*—Casmir A. Nunberg
*Attorney, Agent, or Firm*—Freilich, Hornbaker, Wasserman, Rosen & Fernandez

[57] ABSTRACT

A convertible seat that can convert from a seat to a bed, which includes a coupling pivotally connecting the seat bottom to the seat back, the coupling being longitudinally slideable along a track of the base to facilitate conversion between seat and bed configurations.

2 Claims, 5 Drawing Figures

CONVERTIBLE SEAT

BACKGROUND OF THE INVENTION

This invention relates to a convertible seat which can convert from a seat configuration wherein it forms a sofa, chair, or other furniture piece that supports the back of a seated person, to a bed or other furniture piece that utilizes the former seat back to support the upper half of a reclined person.

Convertible seats have utilized a variety of mechanisms to hold the seat back and bottom in either the seat or bed configuration, and to enable the conversion between these configurations. However, the simplest of those mechanisms have required the person manipulating the mechanism to support some of the weight of the device during the conversion, so that the mechanism was useful only for lightweight convertible seats. Other mechanisms have been provided for heavier convertible seats, such as those convertible between a sofa and a double or wider bed or for sturdy and well upholstered chairs, but these mechanisms have been relatively complex so that they not only involved considerable cost but were subject to malfunction. A mechanism for a convertible seat that was of simple design and yet which enabled support of the seat back and bottom during conversion between a sofa and bed configuration or the like, would enable lower cost construction, more reliable service, and easier operation and repair.

SUMMARY OF THE INVENTION

In accordance with one embodiment of the present invention, a convertible seat device is provided which is of relatively simple design, and which facilitates conversion even for heavier pieces. The convertible seat includes a coupling that pivotally connects the rear of the seat bottom to the lower-front end of the seat back, and which can slide along the base of the convertible seat. A pair of links independently support middle portions of the seat bottom and back on the frame. As the seat converts between the seat and bed configuration, the coupling holds the seat bottom and back in proper relative position while supporting the back and bottom on the frame.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
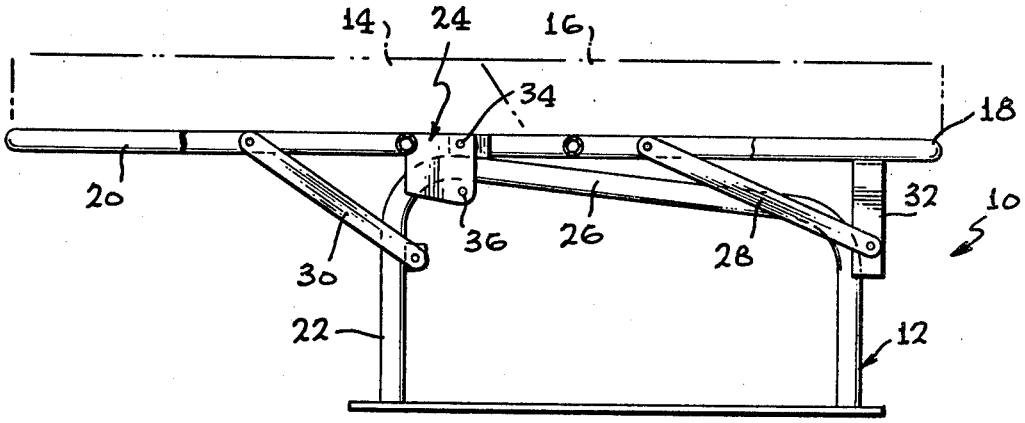
FIG. 1 is a side elevation view of the convertible seat in a bed configuration.
Figure 4:
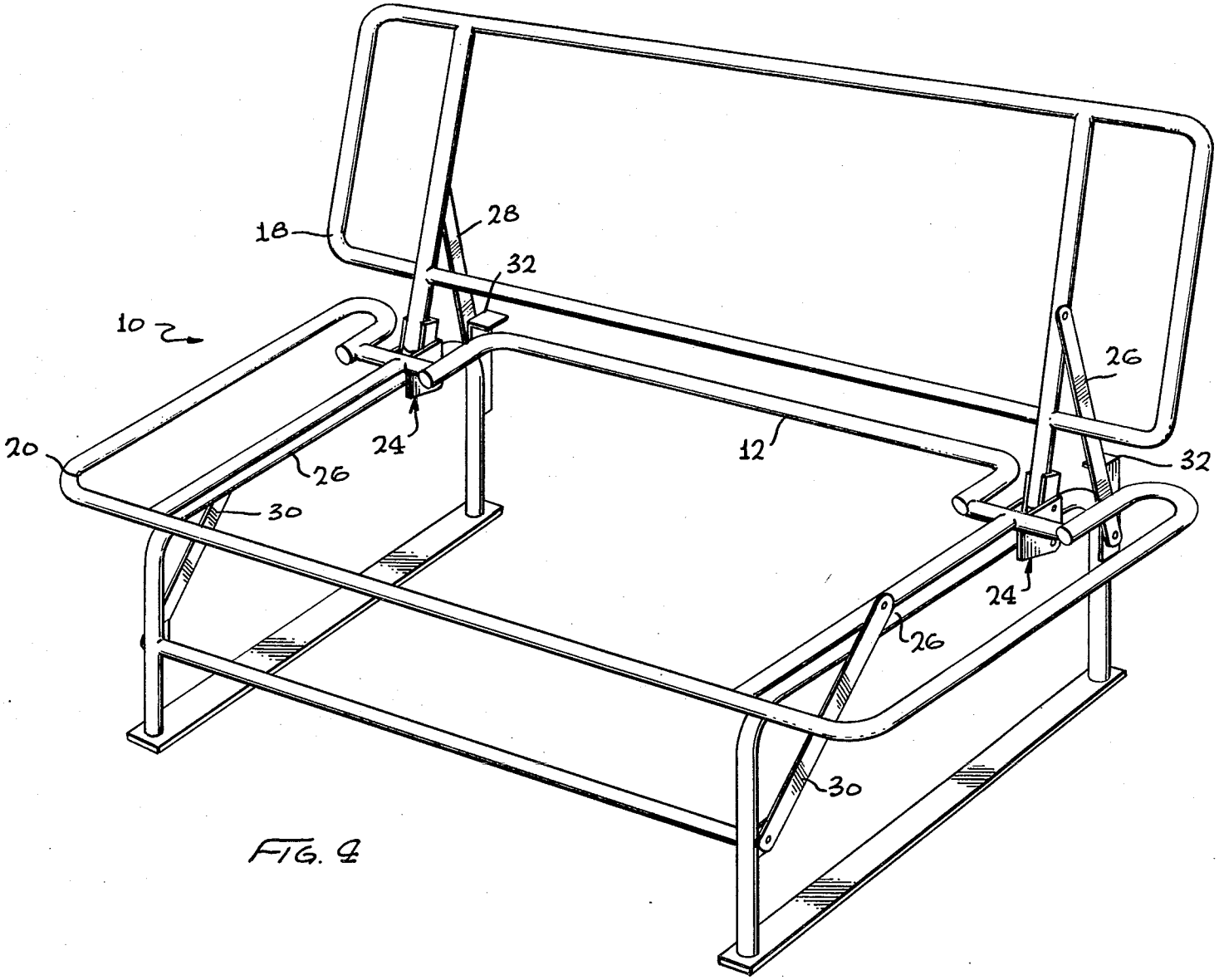
FIG. 4 is a perspective view of the convertible seat of FIG. 3 shown in the seat configuration.

FIG. 1 illustrates a convertible seat 10 of the sofa-to-bed type, which includes a convertible frame 12 and a pair of cushions 14, 16 that are attached to the frame. The frame includes a seat back member 18 that holds a corresponding cushion 16, a seat bottom member 20 that holds another corresponding cushion 14, and a frame base 22. The seat back and seat bottom are pivotally connected together and to the base 22 by a coupling 24 that can slide along a longitudinally-extending portion 26 of the base. In addition, a pair of links 28, 30 are provided to connect the seat back and seat bottom to the base 22. As shown in FIG. 4, the frame actually includes a pair of couplings 24 at either side of the convertible seat, that slide along a pair of track portions 26 of the frame. A pair of links 28 and a pair of links 30 are also provided at opposite sides of the seat. The convertible seat 10 can be mounted in a recreation vehicle, with the bottom of the base bolted to the vehicle chassis.

Figure 2:
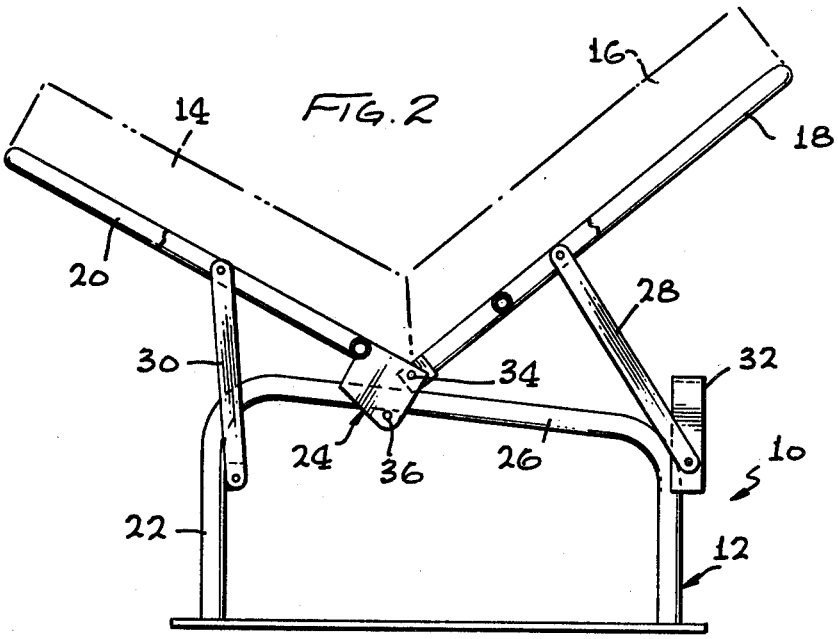
FIG. 2 is a side elevation view of the bed of FIG. 1 in the course of movement from a bed to a seat configuration.

When the convertible seat is in the bed configuration shown in FIG. 1, the upper surfaces of the cushions 14, 16 are substantially at the same level and aligned in a horizontal plane. The weight of the seat back 18 is supported at its rearward end by a bracket 32 and at its forward end by the coupling 24. The seat bottom 20 is supported at its rearward end by the coupling 24 and at its middle to forward portion by the link 30. The seat can be moved from the bed position of FIG. 1 towards the sitting position of FIG. 3 by lifting the rearward portion of the seat back 18. During the conversion, the convertible seat will move through the configuration shown in FIG. 2, wherein the rear of the seat back 18 and the front of the seat bottom 20 have been lifted so they extend at an angle less than the 180° angle at the bed position, and the coupling 24 is sliding rearwardly along the track portion 26 of the base. The links 28, 30 force the seat back and bottom to pivot to these relative configurations during rearward sliding of the coupling.

Figure 3:
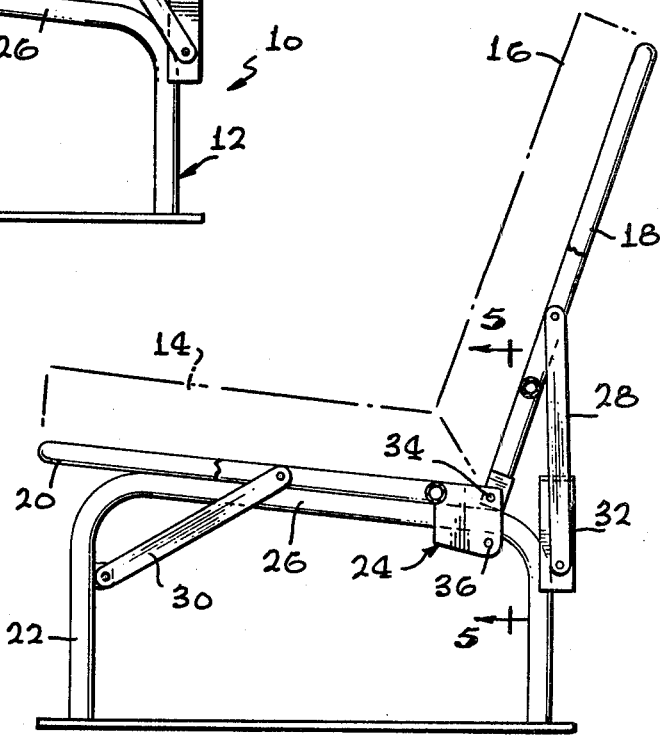
FIG. 3 is an elevation view of the convertible seat of FIG. 2 in a seat configuration.
Figure 5:
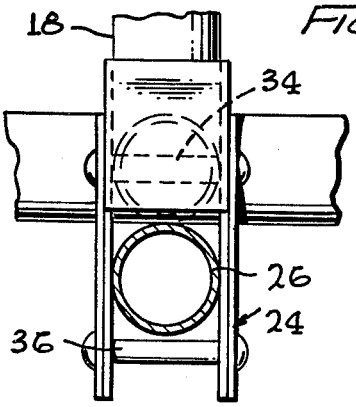
FIG. 5 is a view taken on the line 5-5 of FIG. 3.

When the coupling 24 has slid to its rearward position, the convertible seat will have been converted to its sitting position as shown in FIG. 3. In this configuration, the seat back 18 is supported in a primarily vertical orientation but with a rearward-upward tilt, by the coupling 24 and by the link 28 that extends at a small forward-upward tilt from the vertical. The seat bottom 20 will be supported at its rear by the coupling 24 and at its middle and forward portion by the track portion 26 as well as the link 30. The link 30 limits the rearward sliding of the coupling 24 to a position at which the seat bottom 20 rests on the track portion 26. It may be noted that the track portion 26 extends at a rearward-downward incline, to support the seat bottomm 20 at an incline in the sitting position. However, this does not affect the orientation of the seat back in the bed position, since the bracket 32 is approximately even with the top of the track 26.

The coupling 24 as shown is fixed to the seat bottom member 20 and pivotally connected at 34 to the seat back member 18. Also, a rod 36 extends under the track 26 to prevent lifting up of the coupling. It is possible to pivotally connect the coupling 24 also to the seat bottom 20. Also, it is possible to directly pivotally connect the seat bottom and seat back, and either pivotally or fixedly mount the coupling 14 to one of them, and in that case the rearward end of the seat bottom or forward end of the seat back can be considered to be a portion of the coupling. The coupling 24 could be allowed to lift up from the track 26, but this could hamper smooth conversion between the bed to the sitting position by an inexperienced person.

Thus, the invention provides a convertible seat which can convert between a bed position and a sitting position utilizing a simple mechanism that not only assures that the seat bottom and seat bed will be moved to their proper orientation at either of the two configurations, but which also provide support for both the seat bottom and seat bed during the changing of configurations, to assure a smooth transformation even by an inexperienced person. This is accomplished by the use of a coupling that pivotally connects the seat back to the seat bottom and which can slidably support the front of the seat back and the rear of the seat bottom in slidable movement along the longitudinally-extending track portion of the base of the convertible seat.

Although particular embodiments of the invention have been described and illustrated herein, it is recognized that modifications and variations may readily occur to those skilled in the art, and consequently, it is intended that the claims be interpreted to cover such modifications and eqivalents.

What is claimed is:

1. A convertible seat comprising:

a seat base having a primarily horizontal track that extends at a rearward-downward incline;

a seat back member;

a seat bottom member;

a coupling pivotally connecting said members, and longitudinally slideably along said track formed on said base to slidably contact different locations along said track; and a pair of links respectively coupling said back and bottom members to said base;

said base including a bracket mounted at the rearward end of said track with its top at the height of the top of the track, and positioned to support the rearward portion of said seat back member when it lies horizontal.

2. A convertible seat moveable between seat and bed configurations, comprising:

a seat base (22) having a front and rear portions and having a primarily horizontal track (26) extending between them;

a seat back member (18) having upper and lower ends and a middle portion between them;

a seat member (20) having forward and rearward ends and a middle portion between them;

a coupling (24) pivotally connected to the rear of said seat bottom member and the bottom of said seat back member, said coupling slideably mounted on said track;

a rearward link (28) having an upper end pivotally connected to the middle portion of said seat back member, and having a lower end portion pivotally connected to the rear portion of said frame;

a forward link (30) having an upper end pivotally connected to the middle portion of said seat bottom member and a lower end portion pivotally connected to the front portion of said frame, with said forward link (30) extending at an upward-rearward incline (FIG. 3) when the frame is in the seat configuration and at an upward-forward incline and with its forward end lying in front of the frame (FIG. 1) when the seat is in the bed configuration.

* * * * *